United States Patent [19]

Kondo

[11] 3,967,604

[45] July 6, 1976

[54] DEVICE FOR PREVENTING AN INTERNAL COMBUSTION ENGINE FROM REVOLVING AT MORE THAN THE PREDETERMINED SPEED

[75] Inventor: Tetsuya Kondo, Numazu, Japan

[73] Assignee: Kokusan Denki Co., Ltd., Japan

[22] Filed: June 13, 1974

[21] Appl. No.: 478,900

[30] Foreign Application Priority Data

| | | |
|---|---|---|
| June 14, 1973 | Japan | 48-67243 |
| Oct. 2, 1973 | Japan | 48-115038[U] |
| Oct. 4, 1973 | Japan | 48-115155[U] |
| Oct. 4, 1973 | Japan | 48-115156[U] |

[52] U.S. Cl. ..... 123/118; 123/102

[51] Int. Cl.[2] ..... F02P 1/00

[58] Field of Search ..... 123/118, 102, 148 B

[56] References Cited

UNITED STATES PATENTS

| | | | |
|---|---|---|---|
| 3,356,082 | 12/1967 | Jukes | 123/118 |
| 3,563,219 | 2/1971 | Mieras | 123/118 |
| 3,581,720 | 6/1971 | Hemphill | 123/118 |
| 3,776,204 | 12/1973 | Harris | 123/102 |
| 3,789,810 | 2/1974 | Sattler | 123/102 |

*Primary Examiner*—Charles J. Myhre
*Assistant Examiner*—Ronald B. Cox
*Attorney, Agent, or Firm*—Woodling, Krost, Granger & Rust

[57] ABSTRACT

In an ignition system for an internal combustion engine comprising a power source, an ignition coil including a primary coil portion and a secondary coil portion with said primary coil portion supplied with a primary current from said power source and switching means to break said primary current in time with revolution of the engine whereby a high voltage is induced across said secondary coil portion of said ignition coil, a device for preventing the engine from revolving at more than the predetermined speed including a semiconductor controlled switching element connected in parallel to said primary coil portion of said ignition coil; and a control circuit to control said semiconductor controlled switching element so that it is non-conductive upon said engine revolving at less than the predetermined r.p.m. for normal operation of the ignition system and so that said semiconductor controlled switching element is conductive upon the engine revolving at more than said predetermined r.p.m. whereby it shorts a primary voltage across said primary coil portion of said ignition coil established upon opening of said switching means.

2 Claims, 9 Drawing Figures

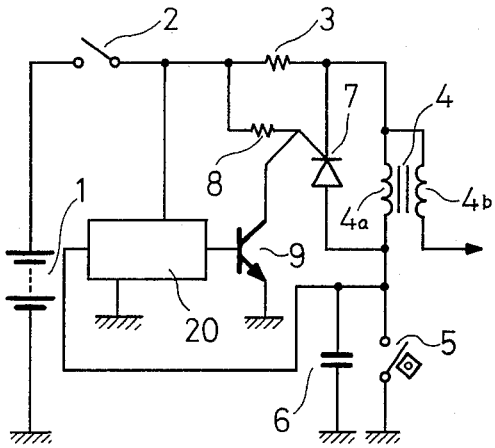
Fig. 1
Fig. 2a
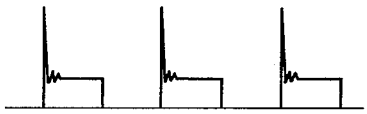
Fig. 2b
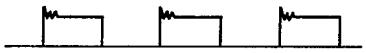
Fig. 3
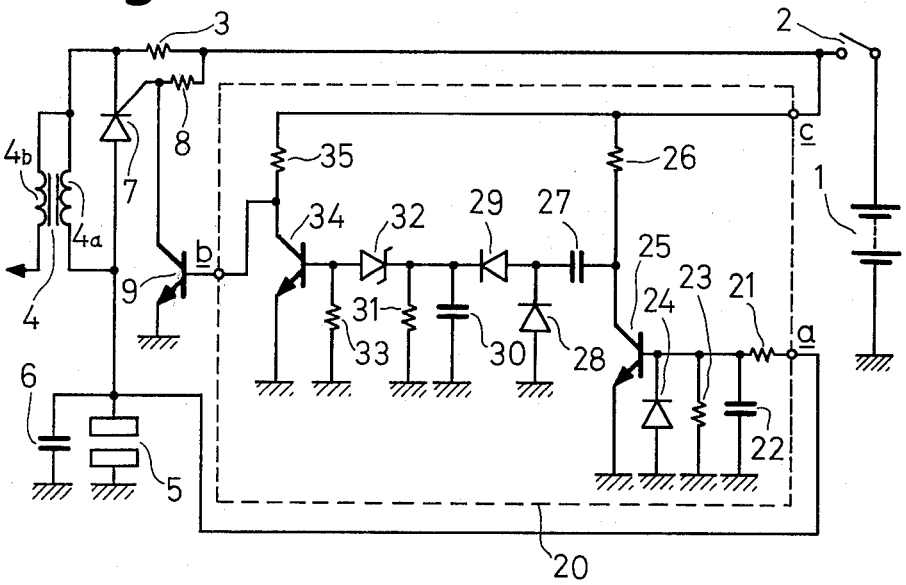
Fig. 4
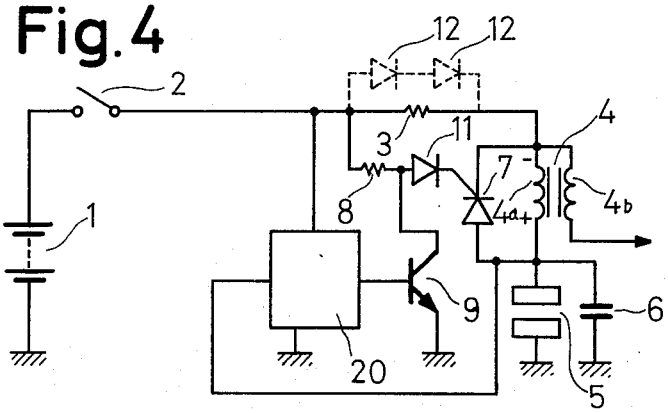

DEVICE FOR PREVENTING AN INTERNAL COMBUSTION ENGINE FROM REVOLVING AT MORE THAN THE PREDETERMINED SPEED

BACKGROUND OF THE INVENTION

This invention pertains to an ignition system for an internal combustion engine with a device to prevent the engine from revolving at more than a given r.p.m. and more particularly to a device to normally operate the ignition system upon the engine revolving at less than the given r.p.m. and to override the ignition system upon the engine revolving at more than the given r.p.m. so that the engine non-operates.

In general, there have been two types of a device for preventing an internal combustion engine from revolving at more than the predetermined speed. One of the devices comprises a switching element connected in series to a primary circuit of an ignition system, wherein when the engine revolves at more than the predetermined r.p.m., the switching element is opened so that the primary current through the primary circuit is continuously interrupted. The other device comprises a switching element connected in parallel to a breaker in a primary circuit of an ignition system, wherein when the engine revolves at more than the predetermined r.p.m., the switching element is closed to thereby override the breaker. In these prior devices, there is required a detector to electrically detect the revolution number of the engine for the operation of the switching elements, which detector conventionally employs the conduction and interruption of the primary current through the ignition system.

However, one of the most disadvantages of the prior arts is that the detector cannot detect or can unstably detect the revolution number of the engine when the device is operative because the primary current remains interrupted while the switching element of the first type of the device is opened or because the constant current continues to flow through the primary circuit while the switching element of the second type of the device is closed. Therefore, during the operation of the device, the detector cannot detect the revolution number of the engine and therefore, when the r.p.m. of the engine becomes lower than the predetermined value, the ignition system cannot retrieve its normal operation.

OBJECTS OF THE INVENTION

It is a principal object of the present invention to provide a device for preventing an internal combustion engine from revolving at more than the predetermined speed, wherein the revolution number of the engine can be acurately detected and wherein the operation and non-operation of the device can be properly effected depending on the r.p.m. of the engine.

SUMMARY OF THE INVENTION

In accordance with the present invention, there is provided a device for preventing an internal combustion engine from revolving at more than the predetermined speed in combination with an ignition system comprising a power source, an ignition coil including a primary coil portion and a secondary ignition coil with said primary ignition coil portion supplied with a primary current from said power source and switching means to interrupt the primary current through the primary coil portion of the ignition coil, said device including a semiconductor controlled switching element connected in parallel to said primary coil portion of said ignition coil; and a control circuit to control said semiconductor controlled switching element so that it is non-conductive upon said engine revolving at less than the predetermined r.p.m. for normal operation of the ignition system and so that said semiconductor controlled switching element is conductive upon the engine revolving at more than the predetermined r.p.m. whereby when said semiconductor controlled switching element is non-conductive said switching means allows said ignition coil to induce a high voltage across said secondary coil portion and when said semiconductor controlled switching element is conductive said semiconductor controlled switching element shorts a primary voltage across said ignition coil established upon opening of said switching means.

In accordance with a typical embodiment of the present invention, the control circuit to control the semiconductor controlled switching element (referred to as semiconductor switching element) connected in parallel to the primary coil portion of the ignition coil in response to the r.p.m. of the engine includes a transistor having a collector connected to the triggering circuit of the semiconductor switching element and a r.p.m. detector to detect the r.p.m. of the engine to have a current supplied to the base of the transistor. The detector is supplied with the voltage across switching means or breaker as its input, which is produced by the conduction and interruption of the breaker to electrically detect the r.p.m. of the engine and to supply the base current to the transistor at less than the predetermined r.p.m. of the engine so that the transistor is conductive. Then, the interruption of the semiconductor switching element, which has a potential maintained at ground, potential permits the ignition coil to induce a high voltage across the secondary coil portion, which allows the normal operation of the ignition system.

Meanwhile, when the r.p.m. of the engine exceeds the predetermined value, the detector at its output is maintained approximately at ground potential and therefore, no base current flows through the transistor causing it to be non-conductive and thereby the semiconductor switching element to be conductive. Hence, because of the primary coil portion shorted by the semiconductor switching element now conductive the secondary coil portion has no high voltage induced there across, causing the ignition system to be non-operative.

In other words, with the device of the present invention, while the engine revolves at more than the predetermined r.p.m., the semiconductor switching element is conductive only upon opening of the breaker to cause the primary voltage across the primary coil portion to be shorted. Accordingly, the primary voltage across the breaker has the waveform as shown in FIG. 2*b* corelating to the revolution of the engine and therefore, the r.p.m. of the engine can be effectively detected by the detector.

Thus, with the present invention, even while the device for prevention of the overrunning of the engine is operated, the primary current is conducted and interrupted through the breaker whereby the detector for electrically detecting the r.p.m. of the engine can be properly functioned and therefore, the device for preventing the engine from revolving at more than the predetermined speed can be effectively operated in response to the output of the detector.

BRIEF DESCRIPTION OF THE ACCOMPANYING DRAWINGS

The above and other advantages and features of the present invention will be apparent from the teaching of the following description of the embodiments taken with reference to the accompanying drawings, in which FIG. 1 is a schematic diagram of a typical embodiment of a device for preventing an internal combustion engine from revolving at more than the predetermined speed, constructed in accordance with the present invention;

FIG. 2*a* shows a waveform of a primary voltage across a primary coil portion of an ignition coil;

FIG. 2*b* shows a waveform of a voltage across a breaker of the ignition system;

FIG. 3 is a schematic diagram illustrating an embodiment of a r.p.m. detector to electrically detect the r.p.m. of the engine; and FIGS. 4 to 8 are schematic diagrams of modifications of the present invention.

DETAILED DESCRIPTION OF PREFERRED EMBODIMENTS OF THE INVENTION

Figure 5:
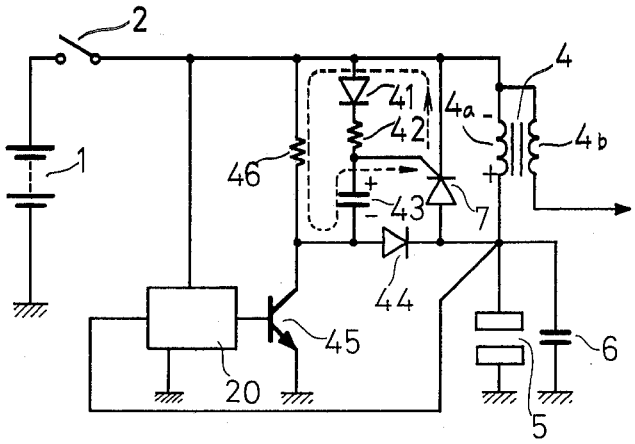

FIG. 1 shows a typical embodiment of an ignition system for an internal combustion engine including a device for preventing the engine from revolving at more than the predetermined speed in accordance with the present invention. The ignition system comprises a primary circuit including a D.C. power source 1, an igniting switch 2, a resistor 3, a primary coil portion 4*a* of an ignition coil 4 and switching means 5 such as a contact breaker with the components sequentially connected in series. The ignition system also comprises a secondary circuit including a secondary coil portion 4*b* of the ignition coil 4 which is connected to an ignition plug (not shown) through a distributor which may be omitted when the engine has only one cylinder or when the ignition system has a corresponding number of the ignition coils to the number of the cylinders.

Switching means 5 is opened and closed in time with the revolution of the engine. While switching means 5 is closed, a primary current flows through the primary circuit and as soon as switching means 5 is opened, the primary current is abruptly interrupted so that a high or secondary voltage is induced across the secondary coil portion 4*b* of the ignition coil 4. Reference numeral 6 designates an arc extinction capacitor connected in parallel to switching means 5.

The device according to the present invention comprises a semiconductor controlled switching element 7 such as silicone controlled rectifier (SCR) connected in parallel to the primary coil portion 4*a* of the ignition coil 4 and a control circuit including a transistor 9 to control triggering of the semiconductor switching element 7 and a r.p.m. detector 20 to electrically detect the r.p.m. of the engine and to control the base of the transistor 9. The transistor 9 is of NPN type, but may alternatively be of any other type.

The semiconductor switching element 7 has the anode connected to the point of the connection between the primary coil portion 4*a* of the ignition coil 4 and switching means 5, the cathode connected to the point of the connection between the primary coil portion 4*a* of the ignition coil 4 and the resistor 3 which serves as a voltage dropping element and the gate connected through a resistor 8 to the point of the connection between the resistor 3 and the igniting switch 2.

The transistor 9 has the collector connected to the gate of the semiconductor switching element 7, the base connected to the output of the r.p.m. detector 20 and the emitter grounded. The r.p.m. detector 20 has the input connected to the point between switching means 5 and the primary coil portion 4*a* of the ignition coil 4. The detector 20 also has supplying terminals one of which is connected to the point between the igniting switch 2 and the resistor 3 and the other of which is grounded.

With this arrangement, switching means 5 is opened and closed in time with the revolution of the engine and the r.p.m. detector 20 detects the voltage across switching means 5. While the r.p.m. of the engine is less than the predetermined value, the r.p.m. detector 20 permits the base current to flow through the transistor 9 at the base thereof so that it is conductive. When the r.p.m. of the engine exceeds the predetermined value, the r.p.m. detector prevents the base current to flow through the transistor 9 so that it becomes non-conductive. Thus, then upon opening switching means 5 the primary current flowing through the primary coil portion of the ignition coil charges the capacitor 6 upon opening of switching means 5 resulting in its rapid interruption. At this time, established across the primary coil portion 4*a* is a primary voltage $$V(L \cdot \frac{di}{dt})$$

which has a polarity so that the primary coil portion 4*a* is positive at the side of switching means 5. Such voltage across the primary coil portion 4*a* is forwardly applied across the anode and cathode of the semiconductor switching element 7. Meanwhile, the primary current flows from the power source 1, through the resistor 3 and also through the primary coil portion 4*a* of the ignition coil 4 to charge the capacitor 6 just before it is interrupted, resulting in a voltage drop across the resistor 3 which causes a current to flow through the resistor 8 to the gate of the semiconductor switching element 7 to thereby close it. With the semiconductor switching element 7 closed, since the primary voltage V established across the primary coil portion 4*a* on opening of switching means 5 is shorted by the semiconductor switching element 7, no high voltage is induced across the secondary coil portion 4*b*, resulting that the engine can be never ignited so that the r.p.m. of the engine is reduced. Thus, when the r.p.m. of the engine becomes less than the predetermined value, the r.p.m. detector 20 permits the base current to flow through the transistor 9 at the base and therefore, the transistor 9 to become conductive. When the transistor 9 becomes conductive, since the semiconductor switching element 7 has the gate potential equaling to the ground potential, the semiconductor switching element 7 remains open so that the primary voltage established across the primary coil portion 4*a* as shown in FIG. 2*a* causes the secondary or high voltage to be induced across the secondary coil portion 4*b* of the ignition coil, for ignition of the engine.

Thus, it will be understood that upon the engine revolving at more than the predetermined r.p.m. the semiconductor switching element 7 operates only when switching means 5 is opened and shorts only the primary voltage V across the primary coil portion of the ignition coil 4. As a result, then the voltage across switching means 5 has the waveform corelating to the r.p.m. of the engine as shown in FIG. 4*b* and the detector 20 is adapted to electrically detect the r.p.m. of the engine. Althrough switching means 5 comprises a contact breaker which mechanically operates, it may comprise a semiconductor switching element. Furthermore, it will be apparent that the semiconductor controlled switching element 7 may comprise a two-way thyristor and in such case the orientation of the semiconductor switching element need not be considered. Also, it will be understood that the power source 1 may alternatively comprise a generating coil or coils in a flywheel type magneto. Of course, the generating coil may serve as the primary coil portion of the ignition coil.

FIG. 3 shows an embodiment of the r.p.m. detector 20 having an input *a* connected through a resistor 21 to a base of a transistor 25 and an output *b* connected to the base of the transistor 9. The r.p.m. detector has a supplying terminal *c* connected to collectors of transistors 25 and 34 through respective resistors 26 and 35, both of which transistors are grounded at the emitters thereof. A capacitor 22, a resistor 23 and a diode 24 are connected in parallel across the base and emitter of the transistor 25, the collector of which is connected to the transistor 34 through a capacitor 27, a forwarded diode 29 and a zenor diode 32. A diode 28, which at the anode thereof is grounded, is connected at the cathode thereof to the point between the capacitor 27 and the diode 29 and a capacitor 30 and a resistor 31, both of which at one ends thereof are grounded, are connected to the point between the Zenor diode 32 and the diode 29.

In operation, when switching means 5 is opened a base current flows from the power source 1 through the primary coil portion 4*a* of the ignition coil 4 and through the resistor 21 to the base of the transistor 25 which causes the transistor 25 to be opened. Thereafter, when switching means 5 is closed, no current flows to the base of the transistor to thereby open it. Simultaneously, a charging current flows from the power source 1 through the resistor 26, through the capacitor 27 and through the diode 29 to the capacitor 30 to charge it. Upon closing of the transistor 25 by switching means 5 opened, the charges in the capacitor 27 flows through the transistor 25 and through the diode 28 to discharge the capacitor 27 while the charges in the capacitor 30 flow through the resistor 31. The capacitors 27 and 30, the latter of which has extremely larger capacitance than the former has, constitute an integrating circuit and the voltage across the capacitor 30 is proportional to the number of the conduction and interruption of the transistor 25, that is the r.p.m. of the engine.

When the r.p.m. of the engine exceeds the predetermined value, the voltage across the capacitor 30 exceeds the Zenor voltage of the Zenor diode 32 causing the base curent to flow through the transistor 34 to turn it on. As a result, the transistor 9 at the base has a ground potential to become non-conductive so that the semiconductor switching element is turned on. As previously described, at this time the semiconductor switching element 7 permits the primary voltage across the primary coil portion 4*a* to be shorted so that no ignition can be effected in the engine. When the r.p.m. of the engine reaches less than the predetermined value, the transistor 34 becomes non-nonductive and as a result the base current flows from the power source 1 through the resistor 35 to the base of the transistor 9 to turn it on so that it turns off the semiconductor switching element 7 for normal operation of the ignition system.

FIG. 4 shows another embodiment of the present invention which is substantially similar to the embodiment of FIG. 1, except that a diode 11 is forwardly disposed between the gate of the semiconductor switching element 7 and the resistor 8 with the collector of the transistor 9 connected to the anode of the diode 11. With this arrangement, the reverse voltage across the cathode and gate of the semiconductor switching element 7 on conduction of the transistor 9 can be checked by the diode 11 so that the semiconductor switching element 7 is prevented from its breakage. The resistor 3 may be replaced by diodes 12 shown in dotted line in FIG. 4 and connected in series to each other which serve as voltage dropping elements.

FIG. 5 shows a modification of the control circuit in the device of the present invention. In the modification, the control circuit may comprise a triggering circuit to trigger the semiconductor switching element 7, which circuit includes series connection of a diode 41, a resistor 42, a capacitor 43 and a diode 44, and a transistor 45 having the emitter grounded, the base connected to the output of the r.p.m. detector 20 and the collector connected through a resistor 46 to the ignition switch 2. The transistor 45 is also connected at the collector to the point between the capacitor 43 and the diode 44 and the semiconductor switching element 7 is connected at the gate to the point between the resistor 42 and the capacitor 43. The diodes 41 and 44 are forwardly arranged with respect to the power source 1 and the charging time constant of the capacitor 43 has less value than the closing period of switching means 5 at the maximum r.p.m. of the engine. The same reference numerals designate the same components as described in the embodiment shown in FIG. 1. Just as descibed in connection with the embodiment of FIG. 1, the r.p.m. detector 20 serves the same function with respect to the transistor 45 as the detector 20 of FIG. 1 serves with respect to the transistor 45.

With the embodiment of FIG. 5, while the r.p.m. of the engine is less than the predetermined value, the conduction of the transistor 45 effected by the detector 20 permits a charging current to flow through the diode 41, the resistor 42, the capacitor 43 and the transistor 45 to charge the capacitor 43 with the polarity shown in FIG. 5 until the voltage across the capacitor 43 reaches the voltage of the power source. Since no gate current flows through the semiconductor switching element 7 due to the cathode of the semiconductor switching element maintained at the positive potential of the power source 1, the semiconductor switching element 7 remains nonconductive and therefore, the ignition system can normally effect the operation according to the conduction and interruption of switching means 5.

When the r.p.m. of the engine exceeds the predetermined value, the r.p.m. detector 20 causes the transistor 45 to be cut off so that charging of the capacitor 43 is effected by switching means 5. Upon closing of switching means 5 the primary current flows through the ignition coil 4 while the charging current flows through the capacitor 43 until it has the voltage of the power source 1. Upon opening of switching means 5 across the primary coil portion of the ignition coil 4 is induced the primary voltage of the polarity shown in FIG. 5, which is then forwardly applied across the anode and cathode of the semiconductor switching element 7. Meanwhile, the capacitor 43 is discharged through the gate and cathode of the semiconductor switching element 7 and then through the resistor 46 and as a result the semiconductor switching element 7 is triggered so that the primary voltage across the primary coil portion 4*a* of the ignition coil 4 is shorted through the semiconductor switching element 7. Thus, no high voltage can be induced across the secondary coil portion 4*b* of the ignition coil 4 so that the engine cannot be ignited until the r.p.m. of the engine is reduced below the predetermined value. At this time, the transistor 45 becomes conductive so that the ignition system retrieves its normal operation. The device can reduce the r.p.m. of the engine below the predetermined value only for a few cycles of the ignition operation. It will be understood that the diode 44 serves to prevent the primary voltage from being shorted upon conduction of the transistor 45.

Figure 6:
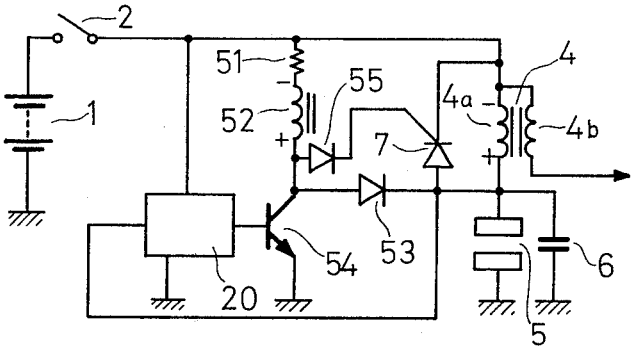

FIG. 6 shows another modification of the present invention in which the triggering circuit for triggering the semiconductor switching element 7 comprises a series connection of a resistor 51, an inductance element 52 and a diode 53 with the series connection connected in parallel to the primary coil portion of the ignition coil 4, and a transistor 54 having the emitter grounded, the base connected to the output of the r.p.m. detector 20 and the collector connected to the point between the inductance element 52 and the diode 53 with the collector of the transistor 54 also connected through a diode 55 to the gate of the semiconductor switching element 7. The same numerals designate the same components as described in connection with the embodiment of FIG. 1.

With the arrangement of FIG. 6, when the r.p.m. of the engine is below the predetermined value, the transistor 54 conducts so that a constant current flows through the inductance element 52 regardless of switching means 5 with the gate of the semiconductor switching element 7 maintained at the ground potential. Therefore, the semiconductor switching element 7 is cut off for normal operation of the ignition system by the conduction and interruption of switching means 5.

However, when the r.p.m. of the engine exceeds the predetermined value, the r.p.m. detector 20 interrupts the conduction of the transistor 54, resulting in the current through the inductance element 52 flowing through switching means 5. Thus, during closing of switching means 5, the primary current flows through the ignition coil 4 and at the same time, the current flows through the inductance element 52. When switching means 5 is opened, the primary voltage across the primary coil portion 4*a* is forwardly across the anode and cathode of the semiconductor switching element 7 while the voltage induced across the inductance element 52 is applied across the gate and cathode of the semiconductor switching element 7 through the diode 55 and the resistor 51, with the result that the semiconductor switching element 7 is triggered so that the primary voltage across the primary coil portion 4*a* is shorted by the semiconductor switching element 7. Thus, no high voltage can be induced across the secondary coil portion 4*b* of the ignition coil 4 whereby the ignition system is overridden to stop the operation of the engine.

When the r.p.m. of the engine becomes less than the predetermined value by means of the non-operation of the ignition system, the transistor 54 becomes so conductive that the ignition system retrieves its normal operation. As previously described in the foregoing embodiments, the normal operation of the ignition system in which the engine can be revolve at less than the predetermined r.p.m. can be retrieved for a few cycles of the operation of the ignition system. It will be also apparent that the diode 53 serves to prevent the primary current from flowing into the triggering circuit for the semiconductor switching element.

Figure 7:
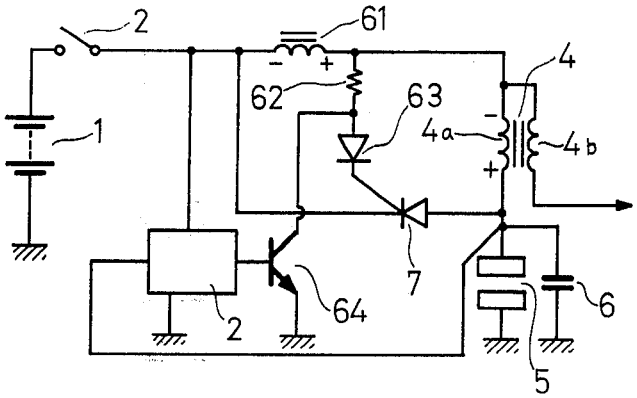

FIG. 7 shows a modification another arrangement of the present device as shown in FIG. 6, wherein an inductance element 61 is connected in series to the primary coil portion 4*a* of the ignition coil 4. Also, the same compotents are designated by the same numerals. In this arrangement, the inductance element 61 at the end adjacent to the ignition coil 4 is connected to the gate of the semiconductor switching element 7 through a resistor 62 and through a forward diode 63. A transistor 64 is connected at the collector to the point between the resistor 62 and the anode of the diode 63. The operation of the device shown in FIG. 7 is substantially identical to that of FIG. 6, except that on operation of the device the primary voltage across the primary coil portion 4*a* of the ignition coil 4 is shorted through the semiconductor switching element 7 and also through the inductance element 61. While the device is not operated, a transient voltage is induced across the inductance element 61 by opening of switching means 5, but such voltage is shorted through the transistor 64 now conducting and then through the power source 1, so that the semiconductor switching element 7 can never be triggered.

Figure 8:
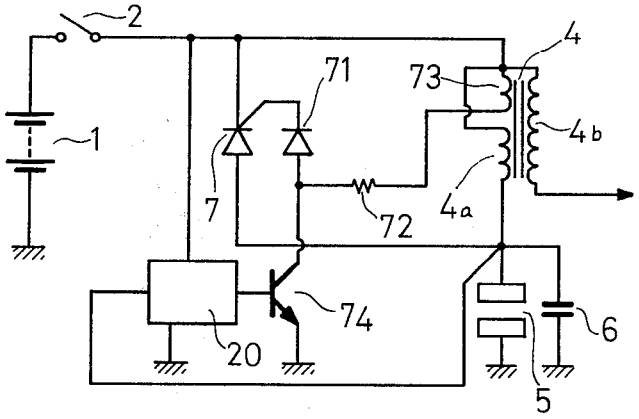

FIG. 8 shows further modification of the present device as shown in FIG. 7 wherein an inductance element 73 corresponding to the inductance element 61 of FIG. 7 is wound around the core of the ignition coil 4 so that a voltage for triggering the semiconductor switching element 7 is induced across the inductance element 73 by means of variation in magnetic flux produced in the core of the ignition coil 4 when switching means 5 is opened. A diode 71 and a resistor 72 correspond to the diode 63 and the resistor 62 of FIG. 7. It will be understood that the operation of the device shown in FIG. 8 is substantially identical to that of FIG. 7.

While some preferred embodiments have been illustrated and described in connection with the accompanying drawings, it will be understood by those skilled in the art that various modifications and changes in the arrangement might be made without the spirit and scope of the present invention, which has been defined only by the appended claims.

What is claimed is:

1. A device for preventing an internal combustion engine from revolving at more than the predetermined speed in combination with an ignition system for the engine comprising a power source, an ignition coil including a primary coil portion and a secondary coil portion with said primary coil portion supplied with a primary current from said power source and switching means to interrupt the primary current through said primary coil portion of said ignition coil, said device including a semi-conductor controlled switching element connected in parallel to said primary coil portion of said ignition coil; and a control circuit comprising a transistor to control triggering of said semiconductor switching element, an r.p.m. detector to control said transistor in response to the r.p.m. of said engine, a series connection of a first diode, a first resistor, a capacitor and a second diode with said series connection connected in parallel to said primary coil portion and wherein said transistor has the emitter grounded, the base connected to the output of said r.p.m. detector and the collector connected through a second resistor to said first diode at the end adjacent to said power source, said transistor at the collector further connected to the point between said capacitor and said second diode and said semiconductor controlled switching element having the gate connected to the point between said first resistor and said capacitor, said control circuit connected to control said semiconductor controlled switching element so that it is non-conductive upon said engine revolving at less than the predetermined r.p.m. and so that said semiconductor controlled switching element is conductive upon said engine revolving at more than the predetermined r.p.m. whereby when said semiconductor controlled switching element is non-conductive it allows said ignition coil to induce a high voltage across said secondary coil portion for normal operation of the ignition system and when said semiconductor controlled switching element is conductive said semiconductor controlled switching element shorts a primary voltage across said ignition coil established upon opening of said switching means for non-operation of the ignition system.

2. A device as set forth in claim 1, wherein said power source is D.C. power source and wherein said first and second diodes are disposed in a forward direction to said D.C. source, said capacitor in said series connection having a charging time constant shorter than the closing period of said switching means at the maximum r.p.m. of said engine.

* * * * *